US006783322B2

(12) United States Patent
Ray et al.

(10) Patent No.: US 6,783,322 B2
(45) Date of Patent: Aug. 31, 2004

(54) PUMP SYSTEM WITH VARIABLE-PRESSURE SEAL

(75) Inventors: Robert B. Ray, Clackamas, OR (US); Joseph H. Reidy, Portland, OR (US); Robert A. McCann, Tigard, OR (US); Steven J. Schoebrun, Tigard, OR (US)

(73) Assignee: Roper Holdings, Inc., Wilmington, DE (US)

( * ) Notice: Subject to any disclaimer, the term of this patent is extended or adjusted under 35 U.S.C. 154(b) by 14 days.

(21) Appl. No.: 10/131,311

(22) Filed: Apr. 23, 2002

(65) Prior Publication Data

US 2003/0198554 A1 Oct. 23, 2003

(51) Int. Cl.[7] ..... F04D 29/10
(52) U.S. Cl. ..... 415/112; 415/231
(58) Field of Search ..... 415/111, 112, 415/113, 231, 170.1; 277/42, 28, 12; 417/9, 423 R

(56) References Cited

U.S. PATENT DOCUMENTS

| | | | |
|---|---|---|---|
| 1,651,881 | A | 12/1927 | Frickey et al. |
| 2,005,429 | A | 6/1935 | Lichtenstein |
| 2,164,485 | A | 7/1939 | Yantis |
| 2,460,849 | A | 2/1949 | Senn |
| 2,687,249 | A | 8/1954 | Papanek et al. |
| 2,960,938 | A | 11/1960 | Williams |
| 2,991,051 | A | 7/1961 | Jones |
| 3,153,382 | A | 10/1964 | Blarcom, Jr. |
| 3,291,473 | A | 12/1966 | Sweeney et al. |
| 3,339,491 | A | 9/1967 | Malloch et al. |
| 3,719,436 | A | 3/1973 | McFarlin |
| 3,746,472 | A | 7/1973 | Rupp |
| 3,839,863 | A | 10/1974 | Frazier |
| 4,078,480 | A | 3/1978 | Luck |
| 4,306,838 | A | 12/1981 | Trainer |
| 4,446,391 | A | 5/1984 | Sekine et al. |
| 4,521,151 | A | 6/1985 | Frater et al. |
| 4,566,855 | A | 1/1986 | Costabile et al. |
| 4,604,035 | A | 8/1986 | Roberts |
| 4,838,763 | A | 6/1989 | Kramer et al. |
| 4,915,579 | A | 4/1990 | Whittier et al. |
| 4,930,986 | A | 6/1990 | Cooper |
| 5,011,166 | A | 4/1991 | Watts |

(List continued on next page.)

FOREIGN PATENT DOCUMENTS

| | | |
|---|---|---|
| DE | 3802949 | 8/1989 |
| EP | 0739079 | 4/1996 |
| JP | 58036151 | 3/1983 |
| WO | WO01/55593 | 8/2001 |

*Primary Examiner*—Edward K. Look
*Assistant Examiner*—James M. McAleenan
(74) *Attorney, Agent, or Firm*—Kolisch Hartwell, P.C.

(57) ABSTRACT

A pump system, including an impeller and an impeller shaft, which has one end secured to the impeller and another end that may be coupled to a motor to drive the impeller. The pump system further includes a substantially liquid-proof barrier which has an opening through which the impeller shaft extends. The opening in the barrier is sealed with a shaft sealing system that includes a supply chamber fluidly coupled with a cavity. The cavity surrounds, and is at least partially bounded by, the impeller shaft. The shaft sealing system further includes a pressure mechanism that is configured to pressurize lubrication matter contained within the supply chamber and cavity, so as to inhibit liquid from passing along the impeller shaft through the cavity and thereby penetrating the liquid-proof barrier. The pressure mechanism is further configured to vary pressure of the lubrication matter based on atmospheric pressure surrounding the pump system.

32 Claims, 7 Drawing Sheets

U.S. PATENT DOCUMENTS

| | | | |
|---|---|---|---|
| 5,028,211 | A | 7/1991 | Mordue et al. |
| 5,101,128 | A | 3/1992 | Veronesi et al. |
| 5,244,348 | A | 9/1993 | Karls et al. |
| 5,322,416 | A | 6/1994 | Karls et al. |
| 5,418,412 | A | 5/1995 | Brucker |
| 5,447,078 | A | 9/1995 | Robinson, Jr. et al. |
| 5,490,768 | A | 2/1996 | Veronesi et al. |
| 5,499,902 | A | 3/1996 | Rockwood |
| 5,622,481 | A | 4/1997 | Thut |
| 5,642,986 | A | 7/1997 | Rose |
| 5,713,727 | A | 2/1998 | Veronesi et al. |
| 5,855,472 | A | 1/1999 | Ravitts |
| 6,079,958 | A | 6/2000 | Qandil |
| 6,183,208 | B1 | 2/2001 | Qandil et al. |

PUMP SYSTEM WITH VARIABLE-PRESSURE SEAL

TECHNICAL FIELD

The present invention relates to pump systems having variable-pressure shaft seals and other mechanisms to protect components from moisture-related damage.

BACKGROUND OF THE INVENTION

Pump systems often include various components and structures designed to protect the bearing frame or other portions of the pump system from pumped liquid or other moisture. For example, many types of pump systems employ various seals in connection with rotating shafts. Such a shaft might be used to drive a pump impeller, to provide rotational output from a motor, or for other purposes. The shaft extends through various openings in the pump system (e.g., through the bearing frame), and these openings are often sealed in order to provide a waterproof barrier or enclosure. In a centrifugal pump, for example, the pump casing typically is sealed at the opening where the impeller shaft enters the casing, in order to prevent pumped liquid from leaking out through the opening along the impeller shaft. Such leakage can potentially cause damage to bearing assemblies, to the motor, or to other components of the pump system, or can cause an environmental hazard. In addition to the shaft seals described above, various other structures and methods may be used to provide protection, including waterproof casings, non-shaft seals, sealed enclosures, etc.

Improving the performance of seals and increasing other protections against water damage are important goals in the design of bearing frames and other pump system components. Depending on the pumping application and/or pumping conditions, the protection afforded by many existing pump systems often is limited or inadequate. Many existing systems are ill-equipped to protect against the risk of flooding, which can lead to damage to bearing assemblies, motors or other components. Existing shaft seals, for example, often are designed to protect against only splashing or brief immersions in liquid. Many pump system components are provided with no protection at all against the risk of flooding.

SUMMARY OF THE INVENTION

Accordingly, an improved pump system is provided, including an impeller and an impeller shaft, which has one end secured to the impeller and another end configured to coupled to a motor in order to drive the impeller. The pump system further includes a substantially liquid-proof barrier which has an opening through which the impeller shaft extends. The opening in the barrier is sealed with a shaft sealing system that includes a supply chamber fluidly coupled with a cavity. The cavity surrounds, and is at least partially bounded by, the impeller shaft. The shaft sealing system further includes a pressure mechanism that is configured to pressurize lubrication matter contained within the supply chamber and cavity, so as to inhibit liquid from passing along the impeller shaft through the cavity and thereby penetrating the liquid-proof barrier. The pressure mechanism is further configured to vary pressure of the lubrication matter based on atmospheric pressure surrounding the pump system.

The pump system may further include a bearing frame through which the impeller shaft extends. In such a case, the shaft sealing system (or more than one such system) may be employed to seal the bearing frame and thereby inhibit penetration of moisture into the bearing frame. In addition to or instead of the shaft sealing system(s), the bearing frame may be provided with a vent that is closeable via operation of a float valve assembly upon flooding of the pump system.

DETAILED DESCRIPTION OF THE INVENTION

Figure 1:
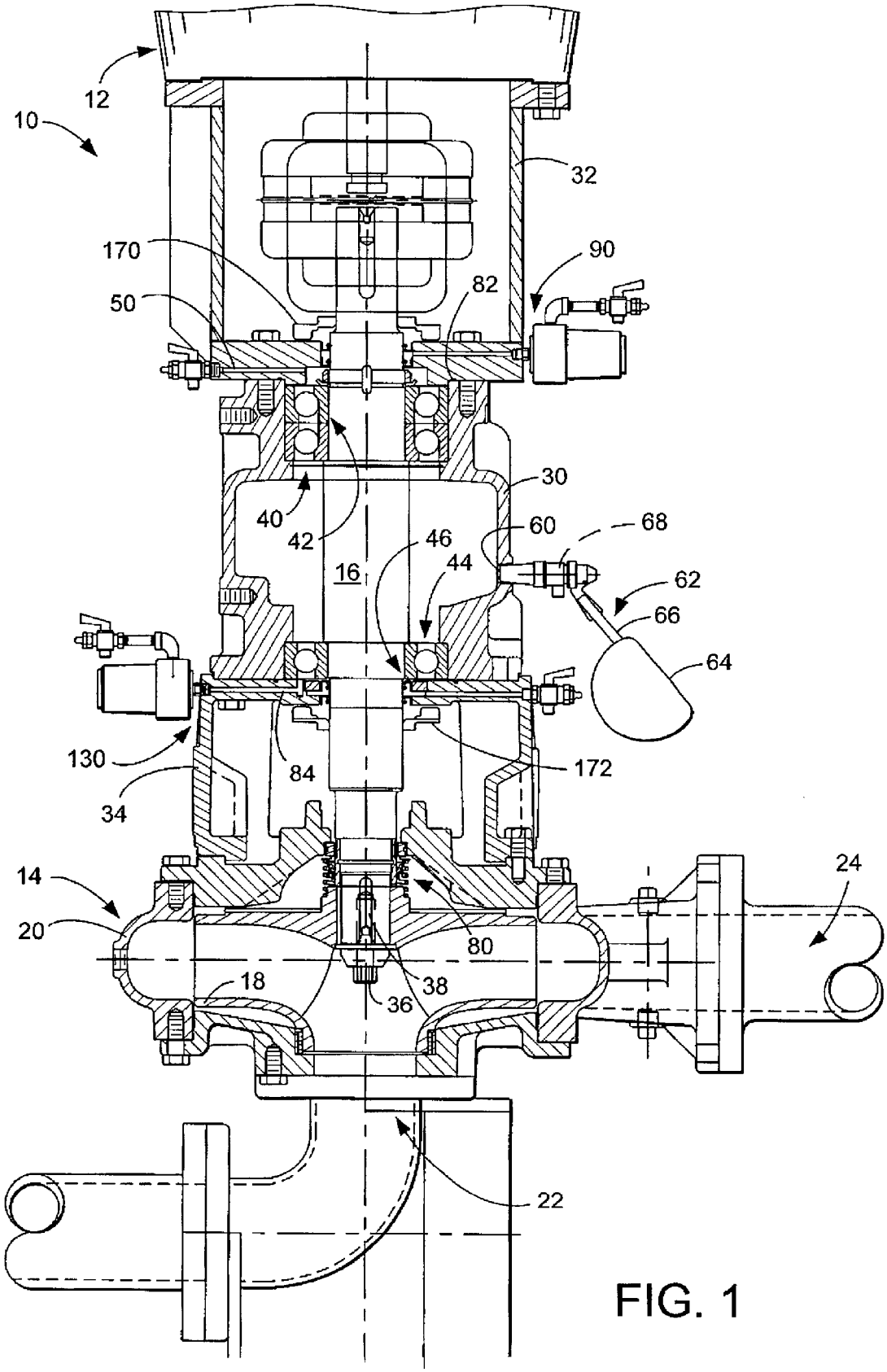
FIG. 1 is a partially cross-sectioned view of a pump system according to the invention.

A pump system is indicated generally at 10 in FIG. 1. Pump system 10 includes a motor 12 coupled to a centrifugal pump 14 via an impeller shaft 16. Pump 14 typically includes an impeller 18 that is disposed within a volute or pump casing 20 and secured to an end of impeller shaft 16. Actuation of motor 12 causes impeller shaft 16 to rotate, which in turn imparts rotation to impeller 18. The rotation of impeller 18 draws liquid through an inlet 22. The drawn liquid passes into the center, or "eye," of the pump and is then discharged through outlet 24 via the centrifugal rotating action of impeller 18.

Centrifugal pumps such as that described above have proved particularly suitable for use with the present invention. The 6NHTA-VC18DB, produced by Cornell Pump Company, is an example of a centrifugal pump that may be used. It should be appreciated, however, that other types of pumps may be implemented in embodiments of the invention as desired.

Pump system 10 may be provided with nearly any type of motor 12. Electric motors, for example, have proved advantageous in many settings. Combustion-type motors may be used as well. Suitability of a given motor typically will depend on the intended use of pump system 10. In some cases, it will be desirable to employ a motor capable of running in both a dry condition and an immersed condition. Examples of such pump/motor systems are set forth in U.S. Pat. No. 6,079,958, by Mark Qandil, entitled "Dry-Pit Submersible Pump Having a Fan and Torque-Relieving Mechanism," and in U.S. Pat. No. 6,183,208, by Mark M. Qandil and Robert B. Ray, entitled "Immersible Motor System," the disclosures of which are incorporated herein by this reference, in their entirety and for all purposes.

Typically, various additional structural components are provided between motor 12 and pump 14. In particular, the depicted pump system includes a bearing frame 30 and mounting brackets 32 and 34. Bracket 34 is secured between centrifugal pump 14 and bearing frame 30, and may be referred to as the pump bracket. Bracket 32 is secured between the bearing frame and motor 12, and may be referred to as the motor bracket.

As indicated, impeller shaft 16 extends through bearing frame 30 and brackets 32 and 34. As indicated, impeller 18 may be fitted to an end of impeller shaft 16 and secured in place via a fastener 36 that is axially aligned with the impeller shaft and secured within a bore 38 in the end of the shaft. Bearing frame 30 typically houses one or more bearing assemblies configured to support and facilitate rotation of impeller shaft 16. For example, the depicted exemplary bearing frame includes an upper bearing assembly 40 positioned adjacent an upper opening 42 of the bearing frame. Lower bearing assembly 44 is provided adjacent a lower opening 46 of the bearing frame. As indicated, pump system 10 may be provided with lubrication channels 50 by which grease or other forms of lubrication are delivered to the bearings.

In many pumping applications, the impeller shaft 16 is subject to significant radial loads and axial (thrust) loads during operation. Brackets 32 and 34, and particularly bearing frame 30, may be designed to withstand these loads to some extent and prevent excessive wear or strain on motor 12. Accordingly, the deployment and design of these components will vary with the intended use of pump system 10.

Pump system 10 typically is provided with various structures to protect components of the pump system from water damage. As with other aspects of pump system 10, the design and implementation of these components will vary depending on the particular pumping application. Some applications, for example, involve frequent partial or full immersion of the pump system. In other cases, the pumping environment is dry nearly all of the time, though there are occasional flood situations which can damage the motor, bearing frame or other components.

Referring still to FIG. 1, pump system 10 typically is provided with one or more sealing structures at various points between motor 12 and impeller 18. Sealing structures may be employed to keep water within a compartment or enclosure, to prevent water from entering an enclosure, to seal a shaft opening, or to otherwise provide a liquid-proof barrier. For example, as indicated, it will often be desirable to seal pump casing 20 at the point where impeller shaft 16 enters the casing. This may be accomplished as shown with a mechanical seal 80 located just inside pump casing 20, to prevent pumped liquid from being discharged into the interior of bracket 34. Other types of shaft seals may be used in addition to, or instead of, mechanical seal 80.

Mechanical seal 80 may be considered a dynamic seal, because it provides sealing between components that move relative to one another: impeller shaft 16 and pump casing 20. Various "static seals" may also be employed in the depicted pump system 10. For example, an o-ring seal 82 is provided between the upper end of bearing frame 30 and the lower end of bracket 32. A similar o-ring 84 is provided between the bearing frame and bracket 34.

Bearing frame 30 may also be sealed to protect the bearing assemblies and other components within the bearing frame from moisture damage. In the depicted system, this is accomplished by sealing the openings through which impeller shaft 16 extends at either end of the bearing frame. In some cases, as in the depicted example, the impeller shaft will extend through aligned openings in multiple structural components. Referring specifically to the upper end of bearing frame 30, impeller shaft 16 extends through aligned openings in the upper end of the bearing frame and the lower end of motor bracket 32. These openings typically are sealed, as described below, such that the adjoining portions of the bearing frame and motor bracket form a liquid-proof barrier.

Figure 2:
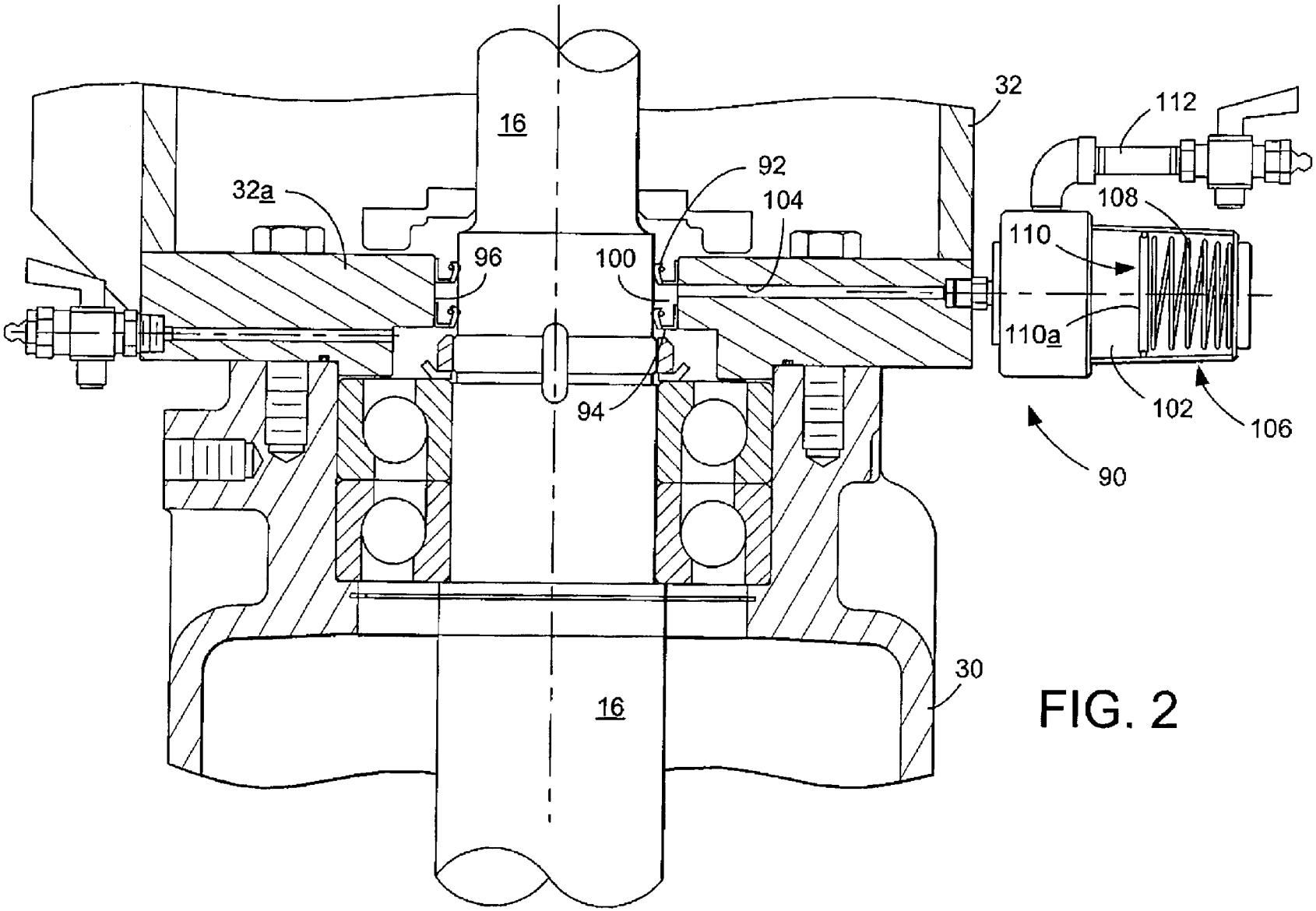
FIG. 2 is an enlarged partially cross-sectioned view of a variable-pressure sealing system that may be implemented in connection with the pump systems of the invention.

Referring now to both FIGS. 1 and 2, a shaft sealing system 90 may be provided to seal the upper end of bearing frame 30. Sealing system 90 includes a double lip seal arrangement (lip seals 92 and 94) positioned within an aperture 96 that is defined through a lower wall portion 32*a* of motor mounting bracket 32. The lip seals may alternatively be secured to bearing frame 30. Lip seals 92 and 94 extend from the edge of the aperture toward the surface of impeller shaft 16. The lip seals are biased into contact with the impeller shaft, often through use of one or more springs. Various types of lip seals may be employed, though an arrangement employing springs in connection with dual Viton® lip seals has proved suitable. In addition to, or instead of springs, the lip seals themselves may be formed with a spring-like characteristic so that the ends of the lip seals are resiliently biased into contact with the impeller shaft.

It will thus be appreciated that a cavity 100 is formed around impeller shaft 16. This cavity is defined partly by the double lip seal arrangement. Specifically, the cavity is bounded by lip seals 92 and 94, by impeller shaft 16, and by portions of bracket 32 which define the aperture through which the impeller shaft is received.

Cavity 100 typically is filled with grease or some other type of lubrication matter such as oil. The grease may be supplied to the cavity from a grease supply chamber 102 that is fluidly coupled with cavity 100 via a channel 104 formed in bracket 32. When cavity 100 is thus filled with grease, the lip seals and grease cooperate to inhibit water or other liquid from passing along impeller shaft 16 through cavity 100. This, in turn, protects against liquid entering the enclosure defined by bearing frame 30.

Grease supply chamber 102 may be contained within a grease cup 106. Grease cup 106 includes a biasing mechanism, such as spring 108, that urges against a movable barrier such as a piston 110 or the like. As indicated, a grease inlet 112 may be provided to allow grease to be added to or removed from supply chamber 102.

Piston 110 includes an operative surface 110*a* that cooperates with a portion of the interior surface of the grease cup to define the boundary of grease supply chamber 102. The urging of piston 110 toward the grease supply chamber pressurizes the grease contained within supply chamber 102, channel 104 and cavity 100. The stiffness of the biasing mechanism (e.g., spring 108) may be varied as desired to change the pressure of the grease. Instead of, or in addition to, the spring and piston arrangement, the grease may be held within an elastomeric bladder, or within some other variable-volume container in order to pressurize the grease.

Figure 3:
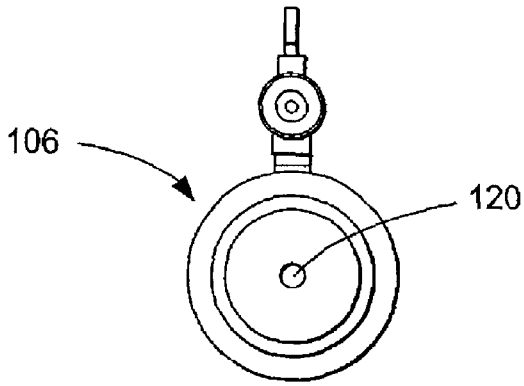
FIG. 3 is an end view of the sealing system shown in FIG. 2.

Sealing system 90 may also be configured to dynamically vary the grease pressure based on atmospheric conditions surrounding pump system 10. As seen in FIG. 3, this may be accomplished by providing one or more openings 120 in the exterior wall of grease cup 106. Because of the opening(s), pressure surrounding the pump system is applied to the movable barrier (e.g., piston 110) which contains the grease. The atmospheric pressure can thus combine with the force exerted by spring 108 to dynamically vary the pressure of the grease contained within cavity 100. Sealing system 90 may thus be considered a variable-pressure sealing system.

The atmosphere-dependent pressure variation can be particularly advantageous in the event of accidental flooding, or in the case of the expected immersions that occur during certain types of pumping operations. In such a case, liquid is allowed to enter grease cup 106 through opening(s) 120. The liquid fills the interior of grease cup 106 on the "spring side" of piston 110. The pressure of the liquid places an added force on piston 110, which in turn increases the pressure of the grease contained within cavity 100. The increase in grease pressure can improve the ability of the sealing system to inhibit pumped liquid from passing through cavity 100, or from otherwise compromising the seal.

The advantages of the variable-pressure sealing system may be seen in the context of a flooded pumping station. In flooded conditions, it is not uncommon for a pump to be under several feet of water. The depth of the immersion increases the risk that water will penetrate sealed barriers or enclosures and damage components of the pump system. For example, immersing pump system 10 under ten feet of water would place considerable pressure on the seals that protect the bearing frame enclosure. The variable-pressure system is configured to compensate for such increased demands placed upon the seal. Specifically, as discussed above, the increased pressure surrounding the pump system because of the flooding produces an increase in the pressure of the grease contained within cavity 100. This, in turn, will increase the effectiveness of the seal and provide protection against the heightened risk of water damage.

A variable-pressure sealing system such as that described above may be used in a variety of locations on pump system 10. In the depicted pump system, for example, the bottom of the bearing frame 30 may be sealed with a variable-pressure sealing system 130 similar to that just described with reference to the upper end of the bearing frame. The described variable-pressure seal may also be used to effect shaft seals on any portion of brackets 32 and 34. The variable-pressure system may further be used in connection with sealing motor 12 or pump casing 20. Indeed, the variable-pressure system may be employed wherever it is necessary or desirable to seal a shaft opening through an enclosure wall or other liquid-proof barrier.

In addition, various types of lubrication matter may be provided within cavity 100 to effectuate a seal. Typically, as described above, grease will provide effective sealing. In other cases, oil or some other type of lubrication matter may be employed.

Figure 4:
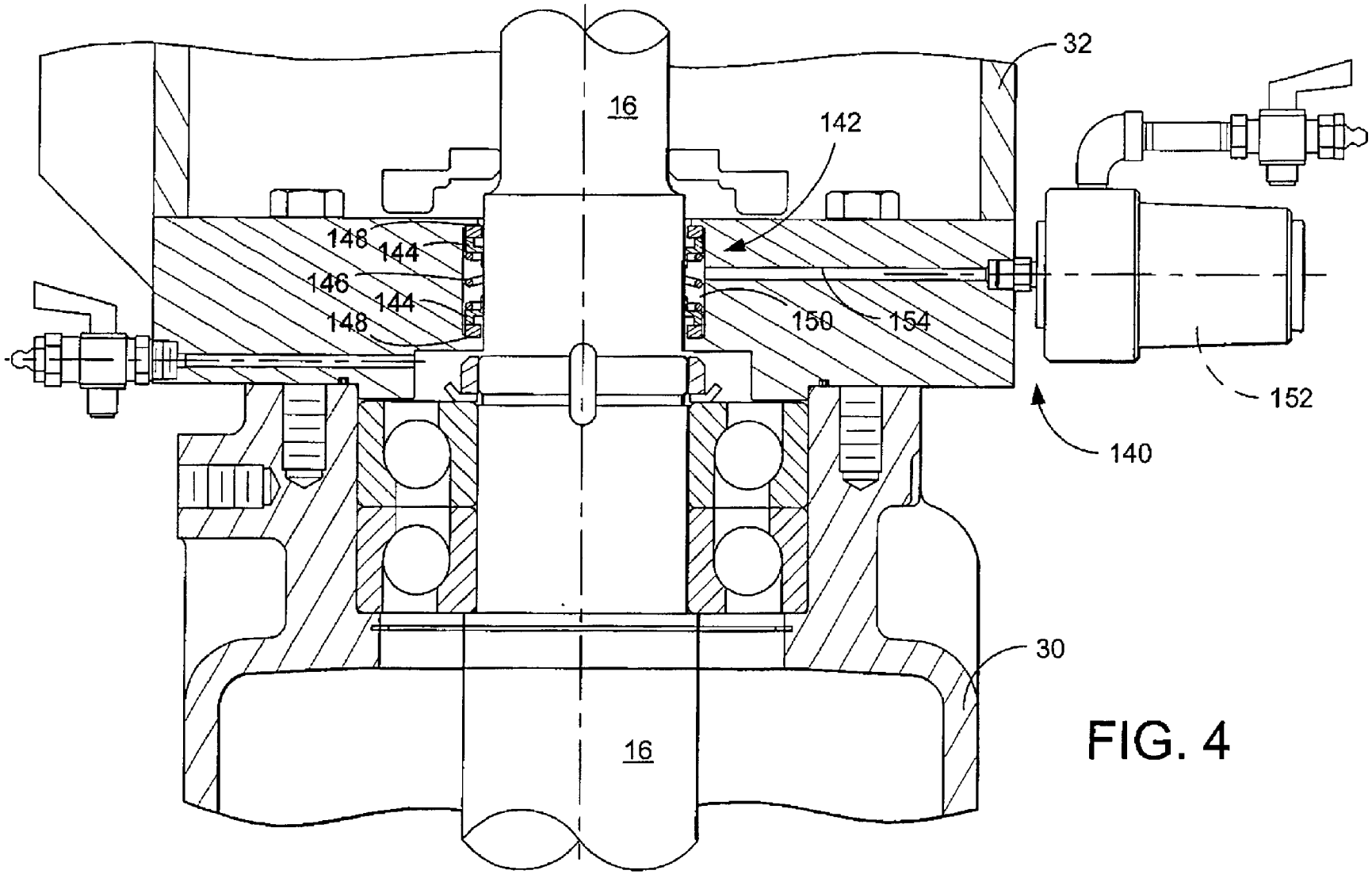
FIG. 4 is an enlarged partially cross-sectioned view of an alternately configured variable-pressure sealing system that may be implemented in connection with the pump systems of the invention.

FIG. 4 depicts a variable-pressure sealing system 140 that may be used in addition to, or instead of, the above-described sealing system 90. Sealing system 140 employs a mechanical seal 142 instead of the double lip seal arrangement shown in FIGS. 1 and 2. Mechanical seal 142 typically includes a pair of rotating faces 144 and a spring 146. Rotating faces 144 are annular and fixed to impeller shaft 16 so that the faces rotate with the shaft but are able to slide vertically along the length of the shaft. Spring 146 is disposed between rotating faces 144, urging them away from each other and into engagement with interfacing portions 148 of bracket 32. A sealed interface is thus created between rotating faces 144 and the corresponding bracket portions 148, which prevents moisture and other contamination from entering the interior of bearing frame 30 along impeller shaft 16.

It will thus be appreciated that the mechanical seal forms a cavity 150 surrounding the impeller shaft, similar to that described above with reference to the double lip seal arrangement. Cavity 150 is bounded by the surface of impeller shaft 16, rotating faces 144, and by bracket 32. Sealing system 140 further includes a lubrication matter subsystem as previously described, including a supply chamber 152 that is fluidly coupled with cavity 150 via a channel 154 defined through bracket 32. Supply chamber 152 may be dynamically pressurized as described above, for example through use of the previously described piston and spring structures, or though other suitable mechanisms. In the depicted mechanical seal configuration, it may be desirable to employ oil as the lubrication matter in cavity 150.

The above examples involve use of a double lip seal and double mechanical seal in connection with the described variable-pressure sealing system. It should be appreciated, however, that other types of seals may be used such as a single mechanical seal, labyrinth seal, etc. Generally, any type of shaft seal may be employed, assuming a cavity can be provided around the shaft in order to contain the lubrication matter.

To provide further protection, pump system 10 may be provided with one or more rotating/centrifugal sealing devices in various locations. Examples of such a device are depicted at 170 and 172 adjacent the upper and lower ends of bearing frame 30 near the impeller shaft openings in the bearing frame enclosure. Devices 170 and 172 may also be referred to as repellers (or expellers), for reasons which will be apparent from the following discussion.

Typically, the repellers are disc-shaped and are press-fitted or otherwise fixed to impeller shaft 16 so that they are positioned near a shaft opening at a close clearance to the sealed barrier in which the shaft opening is defined. For example, in FIG. 1, repeller 170 is fitted to shaft 16 and is positioned at a close clearance to motor bracket 32. Bracket 32 may be modified from the depicted configuration with a cavity or depression sized to accommodate repeller 170.

As shaft 16 rotates, repeller 170 also rotates, and thereby repels fluid away from the center of repeller 170, and away from the sealed impeller shaft opening into bearing frame 30. The rotation of repeller 170 also creates regions of differing pressure. The repelling action and pressure differential further protect against fluid and other matter from entering the bearing frame enclosure along impeller shaft 16.

Figure 5:
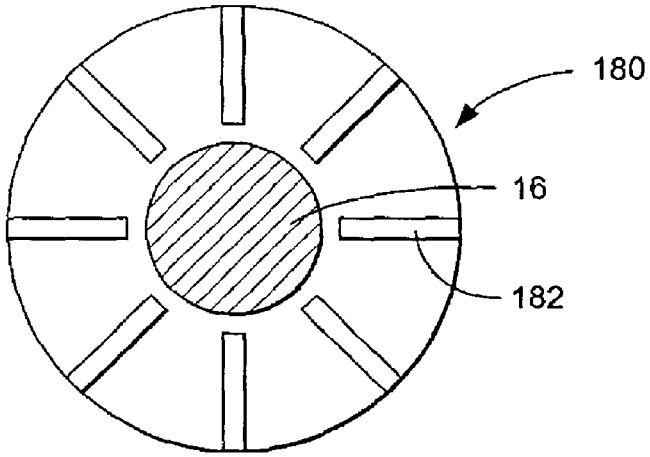
FIGS. 5 and 6 depict embodiments of a rotational/centrifugal sealing device that may be used with the pump systems of the invention.
Figure 6:
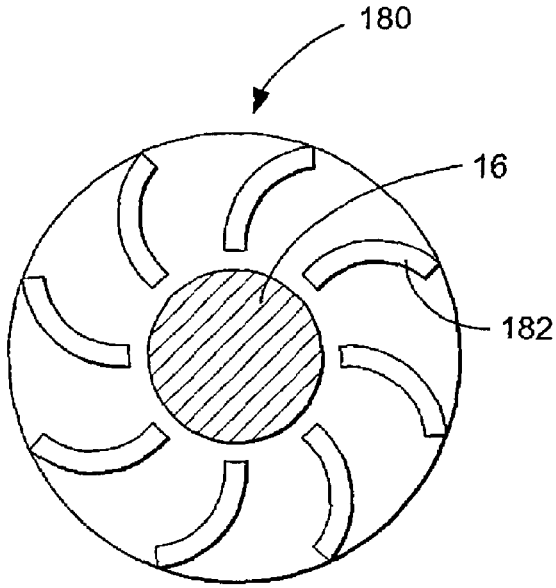

Repellers 170 and 172 typically include at least one, and preferably several, vane(s) or similar structure(s) located on the side of the device that faces the sealed shaft opening, though these structures are not essential. For example, the repeller may be formed without vanes as a smooth disc positioned at a close clearance to the sealed barrier. FIGS. 5 and 6 depict configurations of a repeller 180 having vanes 182, and reveal that the vanes may be curved or radial and straight. The vanes generally are radially configured to extend outward from impeller shaft 16. Alternatively, the vanes may be formed in any shape, size and orientation in order to provide a desired pressure differential and/or level of repelling upon rotation of shaft 16.

The repeller device described above may be configured to provide protection in both wet and dry conditions. When the repeller is used with a pump system that is flooded or otherwise submerged, it helps to prevent liquid from penetrating through a sealed shaft opening as described above. The repeller can additionally provide protection on a pump system that is operated in a non-submerged state. The repeller can provide protection against splashing, for example while the pump system is being washed down, and can also protect against dust and other debris from entering into the sealed opening and sealed enclosure.

Figure 7:
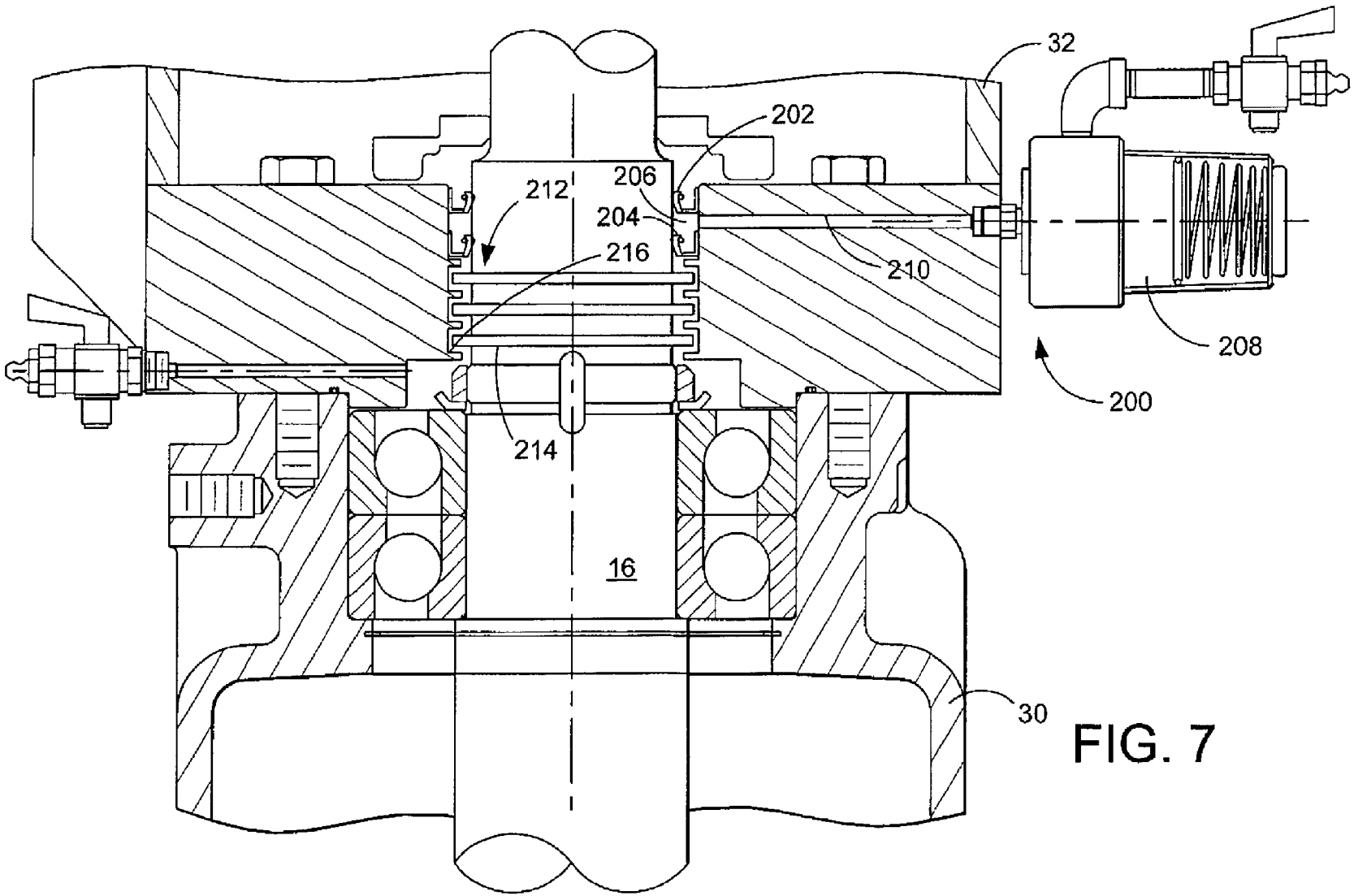
FIG. 7 is an enlarged partially cross-sectioned view of the variable-pressure sealing system of FIG. 2, as used in combination with a labyrinth-type shaft seal.
Figure 8:
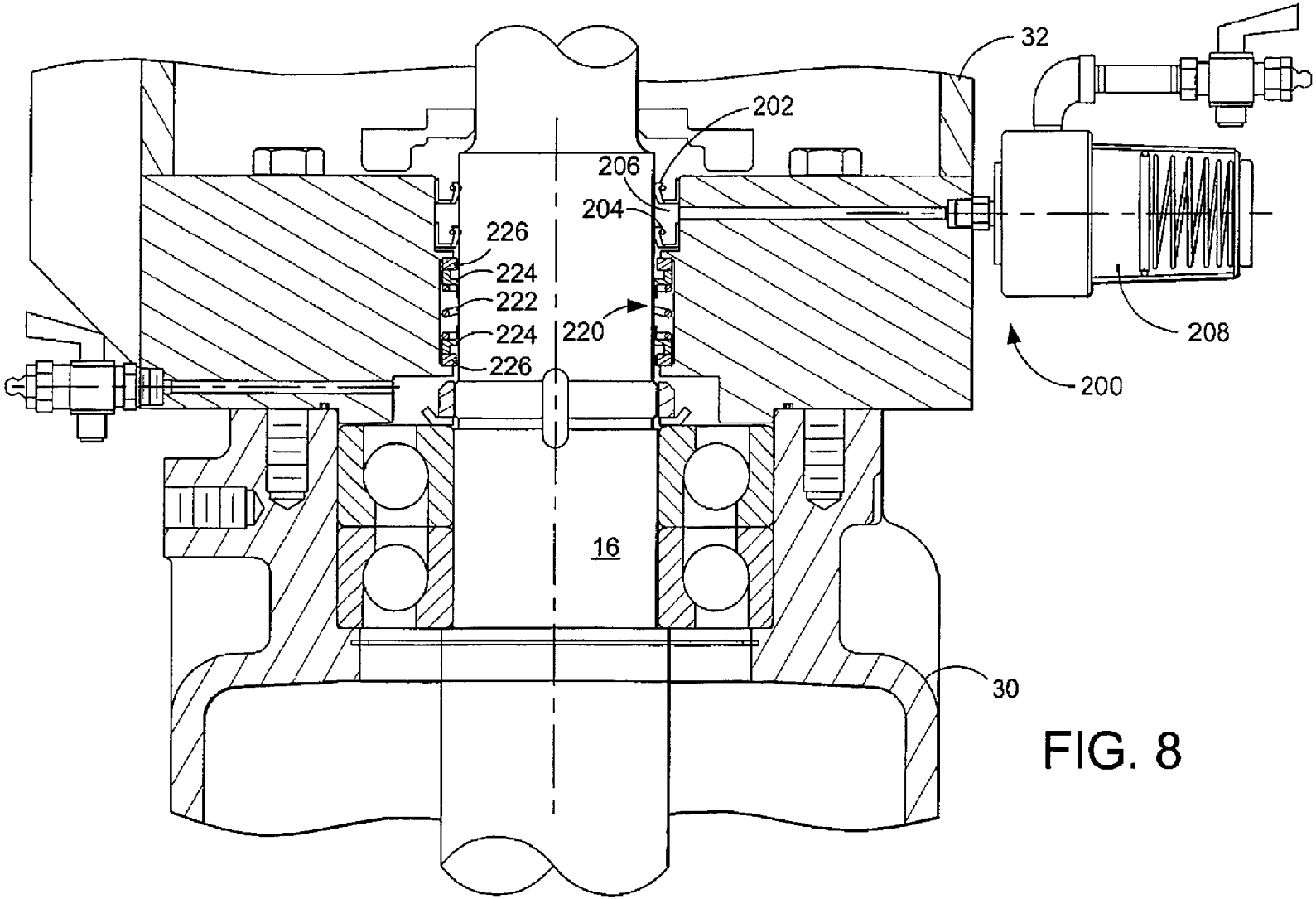
FIG. 8 is an enlarged partially cross-sectioned view of the variable-pressure sealing system of FIG. 2, as used in combination with a mechanical-type shaft seal.

Referring now to FIGS. 7 and 8, additional shaft seals may be employed in combination with the variable-pressure seal systems described above. Referring first to FIG. 7, a variable-pressure seal system 200 is depicted. Seal system is similar to that described above, and includes double lip seals 202 and 204 that cooperate with impeller shaft 16 and bracket 32 to define a cavity 206 that generally surrounds the impeller shaft. Lubrication matter is supplied from a dynamically pressurizable supply chamber 208 through a channel 210 defined in bracket 32. In addition to seal system 200, FIG. 7 shows use of an additional shaft seal in the form of a labyrinth seal 212, including a plurality of ring-like rib structures 214 affixed to impeller shaft 16. Rib structures 214 intermesh with corresponding recesses 216 formed in bracket 32, to further inhibit pumped liquid from passing along impeller shaft 16.

FIG. 8 depicts the variable-pressure seal system of FIG. 7 (i.e., system 200), but in combination with a mechanical seal 220. Several reference numbers from FIG. 7 are shown in FIG. 8, though the corresponding parts will not be described again. Referring particularly to mechanical seal 220, the mechanical seal includes a spring 222 configured to urge rotating face portions 224 of the mechanical seal into contact with portions 226 of bracket 32 so as to create a sealing interface. As revealed by the foregoing examples of FIGS. 7 and 8, and by the preceding discussion, the variable-pressure sealing systems of the invention may be employed in a wide variety of configurations to provide high-performance shaft sealing in a pump system.

As discussed in detail above, bearing frame 30 (FIG. 1) typically is sealed at openings 42 and 46 to protect the bearings from being damaged by water or other liquid entering the bearing frame enclosure. Though the bearing frame is often sealed where impeller shaft 16 passes into and out of the bearing frame (e.g., openings 42 and 46), it will often be desirable to vent the bearing frame. Without such venting, there can be an undesirable increase in pressure within the bearing frame due to heat generated during operation of pump system 10. Such heat can be produced, for example, by friction created by the rotation of impeller shaft 16.

Accordingly, as seen in FIG. 1, bearing frame 30 may be provided with a vent 60 or like opening in the sidewall of the bearing frame, or in another suitable location. As indicated, a float valve assembly 62 may also be provided in connection with vent 60. Float valve assembly 62 includes a float 64 and a linkage 66 coupled between the float and a valve structure 68 that is selectively operable to open and close vent 60. Float valve assembly 62 causes vent 60 to close as water or other liquid rises around the pump system, as would occur for example during the flooding of a pumping station. Specifically, float 64 rises as liquid levels surrounding bearing frame 30 rise. This in turn moves linkage 66 so as to cause valve structure 68 to seal vent 60 shut. The bearing frame is thus vented at all times except when water levels rise to a point where there is a risk of water entering the bearing frame. When water rises to this point, the float valve automatically closes the vent to prevent water damage to the bearings and other components inside the bearing frame.

Figure 9:
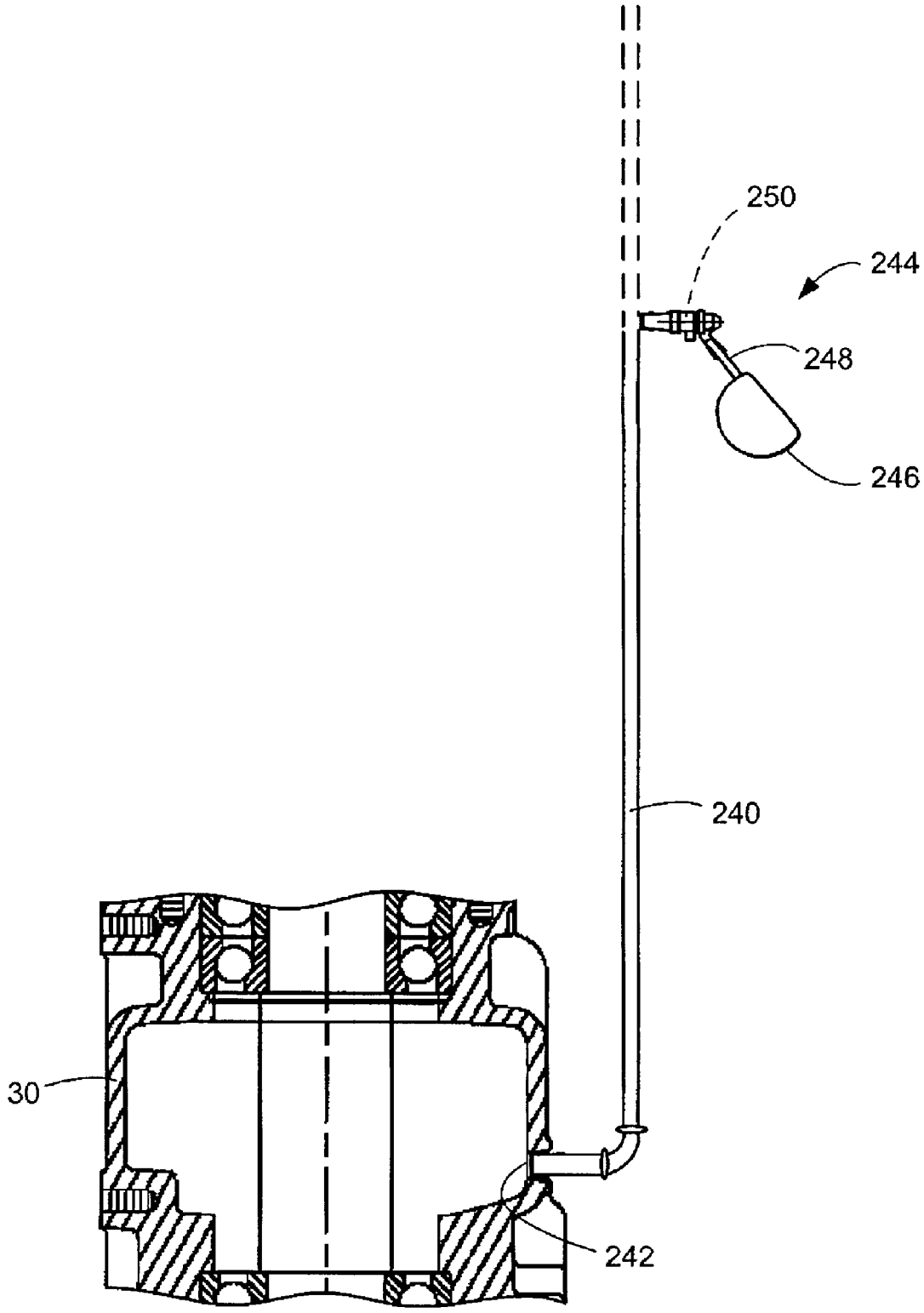
FIG. 9 depicts the bearing frame shown in FIG. 1 with an alternately configured venting system.

FIG. 9 depicts an alternate vent/valve mechanism for selectively venting bearing frame 30. In this alternate configuration, bearing frame 30 is vented through a pipe 240 or like structure connected to a vent opening 242 in bearing frame 30. During non-submerged operation, pipe 240 and opening 242 vent the interior of bearing frame 30. As before, a float valve assembly 244 may be provided to protect the interior of the bearing frame from moisture damage. Float valve assembly 244 includes a float 246 and a linkage 248 coupled between the float and a valve structure 250 that closes to seal off pipe 240 when float 246 is raised by elevated liquid levels.

Use of pipe 240 allows float 246 to be positioned much higher relative to bearing frame 30 than in the previously described configuration, and water thus rises to a higher level before the vent is sealed off by float valve assembly 244. This will be desirable in many cases, because the submerged water can cool the bearing frame prior to closing of the vent. Alternatively, the float valve assembly may be omitted altogether, and pipe 240 may be extended (as indicated by the dashed lines) to a height that is above any anticipated flood level.

While the present invention has been particularly shown and described with reference to the foregoing preferred embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. Where the claims recite "a" or "a first" element or the equivalent thereof, such claims should be understood to include incorporation of one or more such elements, neither requiring nor excluding two or more such elements.

What is claimed is:

1. A pump system, comprising:

an impeller;

an impeller shaft having an impeller end secured to the impeller and a drive end configured to be operatively coupled to a motor in order to drive the impeller; and a substantially liquid-proof barrier having an opening through which the impeller shaft extends, the opening being sealed with a shaft sealing system that includes:

a supply chamber in fluid communication with a cavity that surrounds, and is at least partially bounded by, the impeller shaft; and a pressure mechanism configured to pressurize lubrication matter contained within the supply chamber and cavity so as to inhibit liquid from passing along the impeller shaft through the cavity and thereby penetrating the liquid-proof barrier, where the pressure mechanism is configured to act upon the lubrication matter in the supply chamber to vary pressure of the lubrication matter during operation of the pump system based on atmospheric pressure surrounding the pump system.

2. The pump system of claim 1, where the supply chamber is fluidly coupled with the cavity via a channel.

3. The pump system of claim 2, where the channel is defined through the liquid-proof barrier.

4. The pump system of claim 1, where the pressure mechanism includes a piston having an operative surface that at least partially bounds the supply chamber, where the piston is movable in order to vary pressure applied to the lubrication mailer.

5. The pump system of claim 4, where the pressure mechanism includes a biasing mechanism configured to urge the piston toward the supply chamber so as to maintain pressure in the lubrication mailer.

6. The pump system of claim 5, where the biasing mechanism is a spring.

7. The pump system of claim 6, where the piston and spring are disposed within a housing, such that the operative surface of the piston and an interior surface of the housing define the supply chamber, the spring being positioned opposite the operative surface of the piston.

8. The pump system of claim 7, where a hole is defined through a portion of the housing such that a side of the piston opposite the supply chamber is exposed to atmospheric conditions surrounding the pump system.

9. The pump system of claim 1, where two lip seals are positioned within the opening in the liquid-proof barrier such that ends of the lip seals contact the impeller shaft, and where the lip seals at least partially define the cavity surrounding the impeller shaft.

10. The pump system of claim 1, where a mechanical seal is positioned within the opening in the liquid-proof barrier such that the mechanical seal at least partially defines the cavity surrounding the impeller shaft.

11. The pump system of claim 1, where the impeller shaft extends through and is supported by a sealed bearing frame coupled between the impeller and the motor, and where the shaft sealing system seals around the impeller shaft at an end of the bearing frame.

12. The pump system of claim 11, where the shaft sealing system is one of two such shaft sealing systems, and where the second shaft sealing system seals around the impeller shaft at another end of the bearing frame.

13. The pump system of claim 11, where the bearing frame includes a vent for venting an interior of bearing frame, the pump system further comprising a float valve assembly coupled to the bearing frame and configured to selectively close the vent when the bearing frame is in an at least partially immersed state.

14. The pump system of claim 1, where the lubrication matter is grease.

15. The pump system of claim 1, where the lubrication matter is oil.

16. A pump system, comprising:

an impeller disposed within a pump casing having an inlet and an outlet;

a motor;

an impeller shaft coupled between the motor and the impeller and configured to impart rotation to the impeller upon activation of the motor; and a sealed bearing frame through which the impeller shaft extends, where the bearing frame is secured between the motor and impeller and includes an air vent that is closeable via operation of a float valve assembly upon flooding of the pump system.

17. The pump system of claim 16, where the impeller shaft extends through a sealed opening at a first end of the bearing frame and through a sealed opening at a second end of the bearing frame, each of the sealed openings being sealed with a variable-pressure sealing system including:

a supply chamber in fluid communication with a cavity that surrounds, and is at least partially bounded by, the impeller shaft; and a pressure mechanism configured to pressurize lubrication matter contained within the supply chamber and cavity so as to inhibit liquid from passing along the impeller shaft through the cavity and into the bearing frame, where the pressure mechanism is configured to vary pressure of the lubrication matter based on atmospheric pressure surrounding the pump system.

18. The pump system of claim 17, where for each of the variable-pressure sealing systems, the supply chamber is fluidly coupled with the cavity via a channel.

19. The pump system of claim 17, where for each of the variable-pressure sealing systems, the pressure mechanism includes a piston having an operative surface that at least partially bounds the supply chamber, where the piston is movable in order to vary pressure applied to the lubrication matter.

20. The pump system of claim 19, where for each of the variable-pressure sealing systems, the pressure mechanism includes a biasing mechanism configured to urge the piston toward the supply chamber so as to maintain pressure in the lubrication matter.

21. The pump system of claim 20, where for each of the variable-pressure sealing systems, the biasing mechanism is a spring.

22. The pump system of claim 21, where for each of the variable-pressure sealing systems, the piston and spring are disposed within a housing, such that the operative surface of the piston and an interior surface of the housing define the supply chamber, the spring being positioned opposite the operative surface of the piston.

23. The pump system of claim 22, where for each of the variable-pressure sealing systems, a hole is defined through a portion of the housing such that a side of the piston opposite the supply chamber is exposed to atmospheric conditions surrounding the pump system.

24. The pump system of claim 17, where for each of the variable-pressure sealing systems, two lip seals are positioned within the corresponding sealed opening such that ends of the lip seals contact the impeller shaft, and where the lip seals at least partially define the cavity surrounding the impeller shaft.

25. The pump system of claim 16, where the float valve assembly includes a linkage coupled between a float and a valve structure, the float valve assembly being configured so that the float rises as liquid rises around the bearing frame, thereby moving the linkage and valve structure so as to close the vent prior to liquid rising to a level where it can enter the vent.

26. A pump system, comprising:

an impeller;

a motor; and an impeller shaft coupled between the motor and the impeller and configured to impart rotation to the impeller upon activation of the motor, where the impeller shaft extends through a sealed bearing frame enclosure coupled between the impeller and the motor, and where first and second ends of the bearing frame enclosure are each sealed around the impeller shaft with a variable-pressure sealing system, including:

a supply chamber in fluid communication with a cavity that surrounds, and is at least partially bounded by, the impeller shaft; and a pressure mechanism configured to pressurize lubrication matter contained within the supply chamber and cavity so as to inhibit liquid from passing along the impeller shaft through the cavity and into the bearing frame enclosure, where the pressure mechanism is configured to act upon the lubrication matter in the supply chamber to vary pressure of the lubrication matter during operation of the pump system based on atmospheric pressure surrounding the pump system.

27. The pump system of claim 26, where for each of the variable-pressure sealing systems, the pressure mechanism includes a piston having an operative surface that at least partially bounds the supply chamber, where the piston is movable in order to vary pressure applied to the lubrication matter.

28. The pump system of claim 27, where for each of the variable-pressure sealing systems, the pressure mechanism includes a biasing mechanism configured to urge the piston toward the supply chamber so as to maintain pressure in the lubrication matter.

29. The pump system of claim 28, where for each of the variable-pressure sealing systems, the biasing mechanism is a spring.

30. The pump system of claim 29, where for each of the variable-pressure sealing systems, the piston and spring are disposed within a housing, such that the operative surface of the piston and an interior surface of the housing define the supply chamber, the spring being positioned opposite the operative surface of the piston.

31. The pump system of claim 30, where for each of the variable-pressure sealing systems, a hole is defined through a portion of the housing such that a side of the piston opposite the supply chamber is exposed to atmospheric conditions surrounding the pump system.

32. The pump system of claim 26, where for each of the variable-pressure sealing systems, the cavity is at least partially defined by the impeller shaft and by a dual lip seal configuration including two lip seals that are resiliently biased into contact with the impeller shaft.

* * * * *